US009090395B2

(12) United States Patent
Koumans

(10) Patent No.: US 9,090,395 B2
(45) Date of Patent: Jul. 28, 2015

(54) DRINKING SYSTEM

(75) Inventor: Floris Jan Robert Koumans, Delft (NL)

(73) Assignee: HYDRAVIT B.V., EB Delfgauw (NL)

( * ) Notice: Subject to any disclaimer, the term of this patent is extended or adjusted under 35 U.S.C. 154(b) by 1709 days.

(21) Appl. No.: 12/377,946

(22) PCT Filed: Aug. 22, 2007

(86) PCT No.: PCT/NL2007/050412

§ 371 (c)(1), (2), (4) Date: Sep. 22, 2010

(87) PCT Pub. No.: WO2008/023981

PCT Pub. Date: Feb. 28, 2008

(65) Prior Publication Data

US 2011/0006071 A1 Jan. 13, 2011

(30) Foreign Application Priority Data

Aug. 23, 2006 (NL) ..... 1032359

(51) Int. Cl.

| | |
|---|---|
| ***A47J 31/00*** | (2006.01) |
| ***A47G 19/22*** | (2006.01) |
| ***B67D 7/78*** | (2010.01) |
| ***B65D 1/04*** | (2006.01) |
| ***B65D 81/32*** | (2006.01) |
| ***B65D 51/28*** | (2006.01) |

(52) U.S. Cl.

CPC ..... *B65D 81/3216* (2013.01); *B65D 51/2807* (2013.01)

(58) Field of Classification Search

CPC ..... B65D 51/2807; B65D 81/3216

USPC ..... 220/705, 662, 711, 425, 521, 23, 277; 215/6, 229, 388, 253, 12.1, 10, 16, 215/228, 11.3, 11.1, 11.6, 389, 308, 309, 215/311; 222/83, 87, 91, 541, 142.5, 6, 222/229, 388, 253, 145.1

See application file for complete search history.

(56) References Cited

U.S. PATENT DOCUMENTS

| | | | | |
|---|---|---|---|---|
| 3,291,331 | A * | 12/1966 | Grisham et al. | 215/388 |
| 3,347,403 | A | 10/1967 | Lehrman | |
| 5,114,011 | A * | 5/1992 | Robbins, III | 206/499 |
| 5,197,602 | A * | 3/1993 | Biesecker et al. | 206/514 |
| 5,881,894 | A * | 3/1999 | Gargano | 215/228 |
| 6,180,149 | B1 | 1/2001 | Gramm | |
| 6,474,508 | B1 * | 11/2002 | Marsh | 222/83 |

(Continued)

FOREIGN PATENT DOCUMENTS

WO 2006004345 1/2006

OTHER PUBLICATIONS

The International Search Report as mailed on Dec. 11, 2007 for International Patent Application PCT/NL2007/050412.

*Primary Examiner* — Dana Ross
*Assistant Examiner* — Ket D Dang
(74) *Attorney, Agent, or Firm* — Quarles & Brady LLP

(57) ABSTRACT

A drinking system includes a drinking bottle provided with an outflow opening, a storage tube, and a dose container. The storage tube holds a stock of additive for use in the dose container holding a dose of additive in the outflowing beverage when beverage is drunk from the drinking bottle. The storage tube and dose container are, as alternatives, receivable in the drinking bottle via the outflow opening.

23 Claims, 5 Drawing Sheets

(56) References Cited

U.S. PATENT DOCUMENTS

| | | | | |
|---|---|---|---|---|
| 7,032,745 | B2 * | 4/2006 | Saulle | 206/219 |
| 2002/0189956 | A1 * | 12/2002 | Schoo et al. | 206/219 |
| 2005/0056610 | A1 * | 3/2005 | Randolph et al. | 215/11.1 |
| 2006/0102581 | A1 * | 5/2006 | Yates, III | 215/6 |
| 2006/0118435 | A1 * | 6/2006 | Cronin et al. | 206/219 |

* cited by examiner

DRINKING SYSTEM

CROSS-REFERENCE TO RELATED APPLICATIONS

This application claims priority to PCT International Application No. PCT/NL2007/050412 filed on Aug. 22, 2007, which claims priority to Dutch Application No. NL 1032359 filed on Aug. 23, 2006.

STATEMENT REGARDING FEDERALLY SPONSORED RESEARCH OR DEVELOPMENT

Not applicable.

FIELD OF THE INVENTION

The invention relates to a drinking system with which consumers can consume a beverage, in particular a beverage with an additive.

BACKGROUND OF THE INVENTION

Nowadays, the consumer has plenty of choice of beverages to which one or more additives have been added to provide the beverage with an added value. These are, for instance, sports drinks, health drinks, neutraceuticals, cosmeceuticals or functional foods. This nearly always involves a beverage which is produced and offered in a standard composition. These beverages are nearly all based on water to which the additives have already been added. In order to facilitate consumption, these beverages are prepackaged in drinking bottles, i.e. bottles where the consumer can consume the beverage directly from the bottle and whose contents are intended to be drunk within a period of time of a few minutes or a few hours. In order to facilitate drinking, the drinking bottle may then be provided with a special drinking cap from which one can drink, such as for instance a push-pull cap.

In practice, the consumer needs to purchase a new drinking bottle filled with beverage each time.

A drawback thereof is that each time providing a new drinking bottle and cap increases the costs of the beverage, and has an environmental impact. Further, a drawback of prepackaging a beverage in drinking bottles in this manner is that the distribution is relatively inefficient because relatively much water and relatively many packagings are transported. Further, the beverage prepackaged in drinking bottles takes up much space in storage and at the location where the beverage is offered to the consumer. These aspects also increase the cost price of the beverage.

As an alternative for consuming a prepackaged beverage from drinking bottles, it is possible to add additives to the beverage prior to drinking; for instance, there are syrups to make lemonade and there are effervescent tablets to make a vitamin drink. Typically, then the beverage is not consumed from a drinking bottle, but from a cup. A drawback of this method is that, compared to consuming a prepackaged beverage from a drinking bottle, adding the correct dose prior to drinking is relatively laborious and complex.

Further, certain additives do no not dissolve easily and they form a precipitate on the beverage container. In addition, a drawback of prepackaged beverages and syrups is that relatively many colorings, aromatic substances and preservatives need to be provided to make the product look well and to be able to keep it well. Also, many beverages are relatively acid in connection with the shelf life, so that beverages need to be sweetened strongly. This sweetening is less desirable for one's health.

SUMMARY OF THE INVENTION

The invention contemplates an alternative drinking system whereby above-mentioned drawbacks can be obviated, and whereby advantages can be offered.

To this end, the invention described herein provides a drinking system with a storage tube and a dose container which are, as alternatives, receivable in the bottle, the drinking bottle can be configured in two manners.

In a first configuration, where the drinking bottle is preferably not filled with a beverage, the storage tube is received in the drinking bottle. In this configuration, the drinking system can easily be transported, be stored and be offered. If desired, in the first configuration, the drinking bottle may already be filled with drinking water for the first use. In the first configuration, the dose container may, for instance, be snapped on the side of the cap or drinking cap facing away from the drinking bottle. In a second configuration, the drinking bottle is filled with a beverage, preferably water, by the consumer and the dose container with a dose of additive received therein is received in the bottle. When beverage is drunk from the drinking bottle, this second configuration can provide the outflowing beverage with the dose of additive during drinking.

Because the storage tube contains a stock of additive, the drinking bottle can be reused a number of times. This considerably reduces packaging, storage and transport costs. Because use can be made of a fixed dose of additive, preferably by incorporating the additive in a tablet, the addition of the additive can simply be carried out. Because the beverage volume in the bottle with normal filling is known, reaching a correct dose can be simple. Preferably, a single dose, for instance one tablet, corresponds with a normal, complete filling of the drinking bottle. Because the dose of additive is taken along by the outflowing liquid during drinking, substances which are less soluble can also be used as an additive, and pollution of the bottle by, for instance, precipitate can be prevented. Preferably, with a normal degree of filling, in standing orientation of the drinking bottle, the dose container positions the dose above the liquid level of the beverage, and preferably at a distance from the outflow opening. Because the dose of additive is taken along during drinking, it is not necessary to provide colorings and aromatic substances. When the dose of additive is in dry form, such as for instance in a tablet form, often fewer or no preservatives are sufficient.

When the stock of additive in the storage tube is depleted, optionally buying a new storage tube without drinking bottle may be sufficient. If desired, a new dose container may be provided then, for instance by snapping a dose container on a replacement or alternative storage tube.

The additive may, for instance, be a liquid or gel, but is preferably a solid substance. The dose may, for instance, be incorporated in a capsule or a sponge-like carrier, but is preferably incorporated in a tablet.

By incorporating the dose of additive in an effervescent tablet, it can be achieved that the tablet disintegrates in a controlled manner, so that the additive is more easily taken along by the outflowing beverage during drinking. Another advantage of such an effervescent tablet is that it can make the beverage effervesce somewhat at the moment of drinking.

The beverage is preferably drinking water, since this has a neutral taste and color, and is normally amply available.

The invention also relates to a drinking bottle with a drinking cap, and a stock of additive received in the drinking bottle.

The invention further relates to a drinking bottle with a drinking cap and a dose container receivable in the outflow opening of the bottle for holding a dose of additive in the outflowing beverage when beverage is drunk from the drinking bottle.

The invention further relates to a storage tube for holding a stock of additive and a dose container detachably coupled therewith for receipt in the outflow opening of a drinking bottle.

Further advantageous embodiments of the invention are set forth in the subclaims. It is noted that further elaborations of the parts of the drinking system described in the subclaims with the first independent claim for the drinking system are also understood to be possible further elaborations of the parts described in the other independent claims for the drinking system.

BRIEF DESCRIPTION OF THE DRAWINGS

The invention will be explained in more detail on the basis of a preferred embodiment which is given by way of non-limiting exemplary embodiment. In the drawings.

DETAILED DESCRIPTION OF THE EXAMPLE EMBODIMENTS

Figure 1:
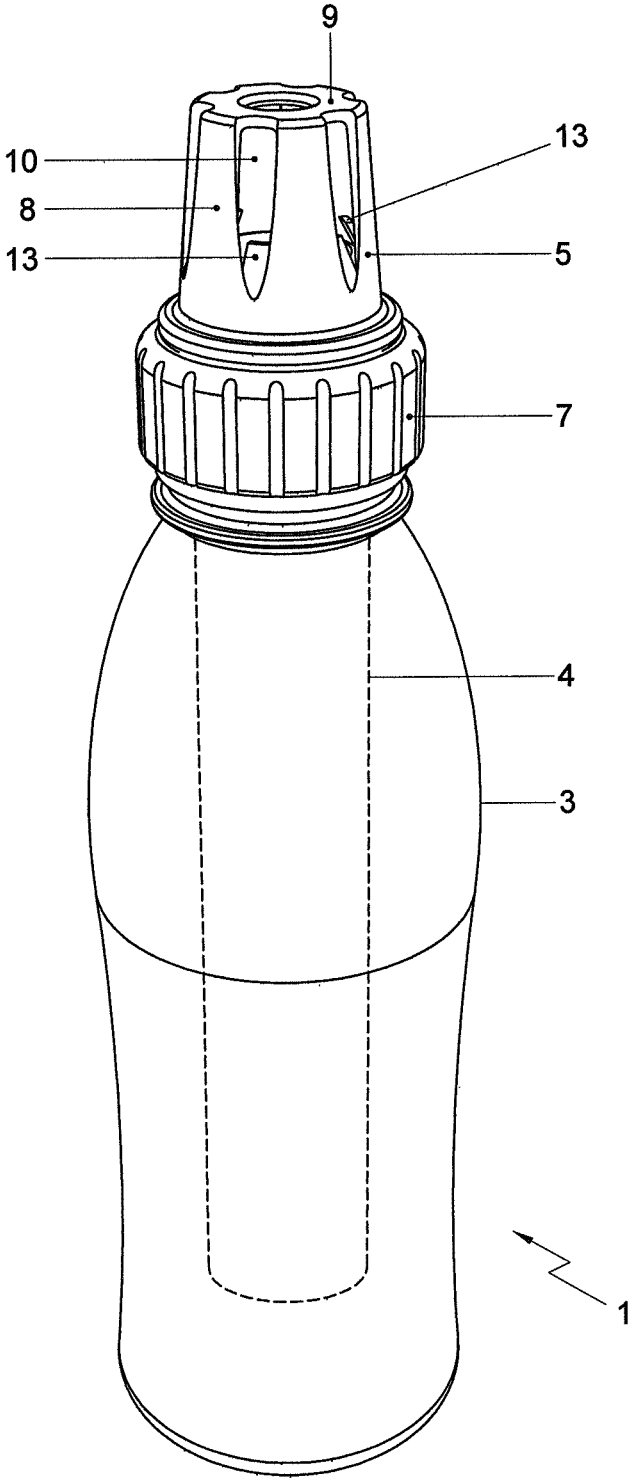
FIG. 1 shows a schematic perspective view of a drinking system in a first configuration in assembled condition.

In the Figures, same or corresponding parts are designated by the same reference numerals.

The exemplary embodiment relates to a drinking system 1 with a drinking bottle 3 provided with an outflow opening 2.

The drinking system 1 further comprises a storage tube 4 for holding a stock of additive. The drinking system 1 further comprises a dose container 5 for, when beverage is drunk from the drinking bottle, holding a dose 6 of additive in the outflowing beverage.

The storage tube 4 and the dose container 5 are each, as alternatives, receivable in the drinking bottle 3 via the outflow opening 2.

Figure 2:
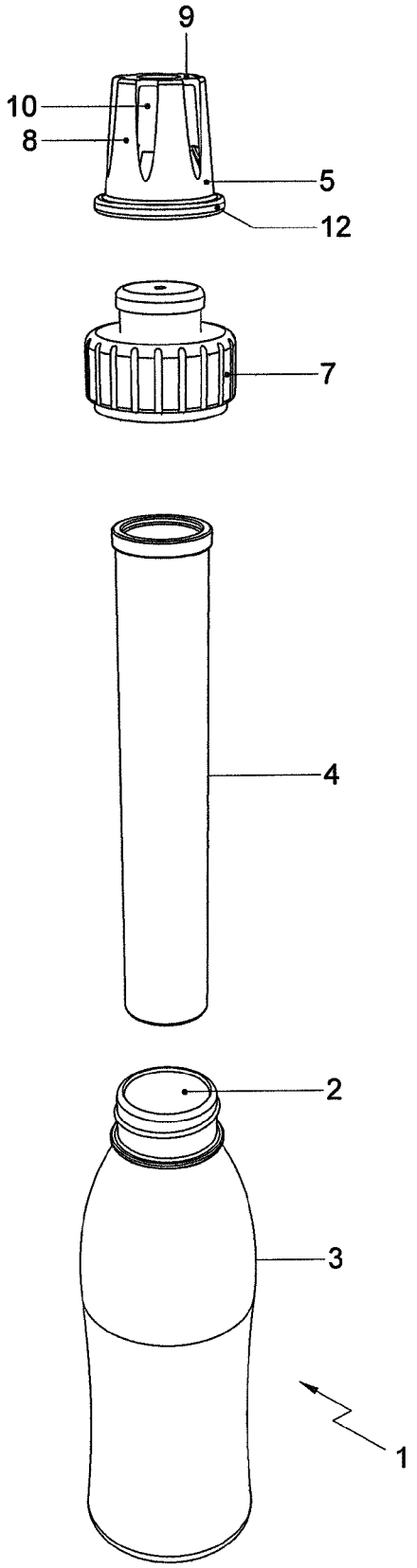
FIG. 2 shows a schematic perspective view of the drinking system of FIG. 1 in disassembled condition.
Figure 3:
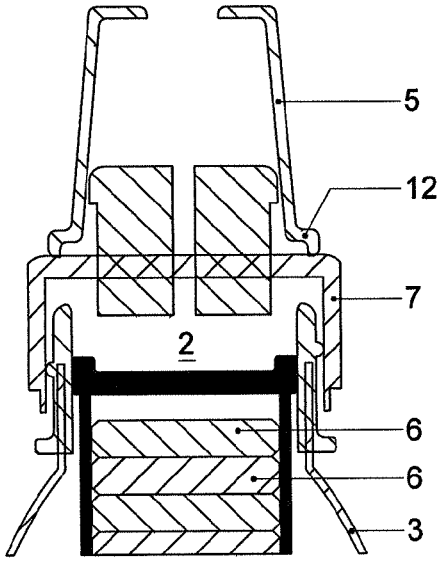
FIG. 3 shows a schematic cross-section detail view of the top side of FIG. 1.

FIGS. 1, 2 and 3 show a first configuration of the system, where the storage container is received in the bottle via the outflow opening. In this exemplary embodiment, the dose container 4 is detachably coupled with a drinking cap 7 via a snap connection on the side of the drinking bottle 3 facing away from the drinking bottle.

Figure 4:
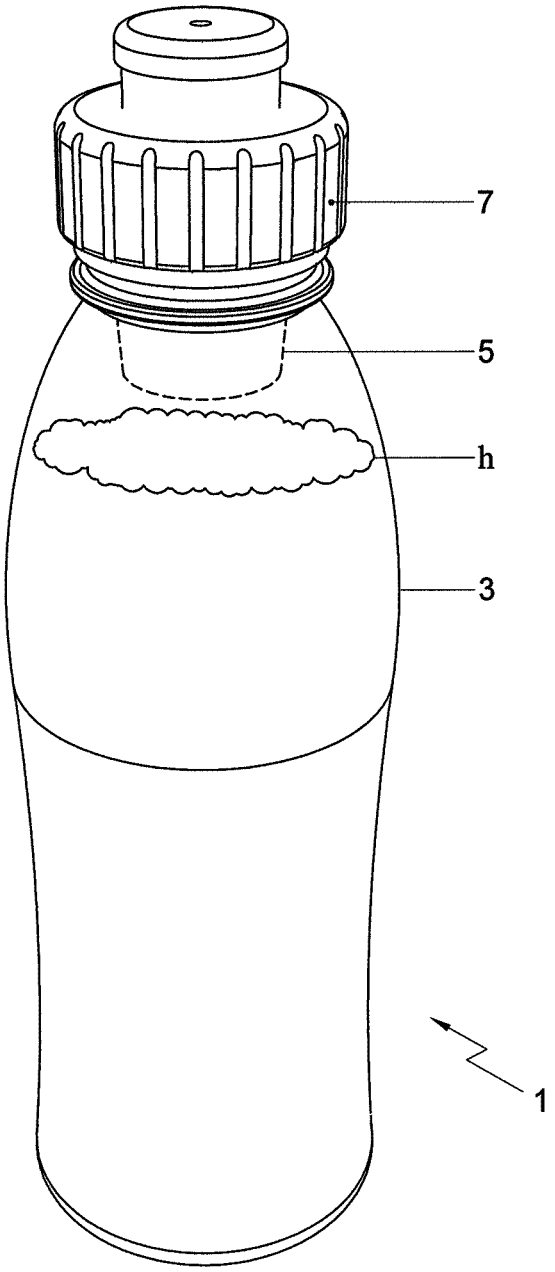
FIG. 4 shows a schematic perspective view of the drinking system in a second configuration in assembled condition.
Figure 5:
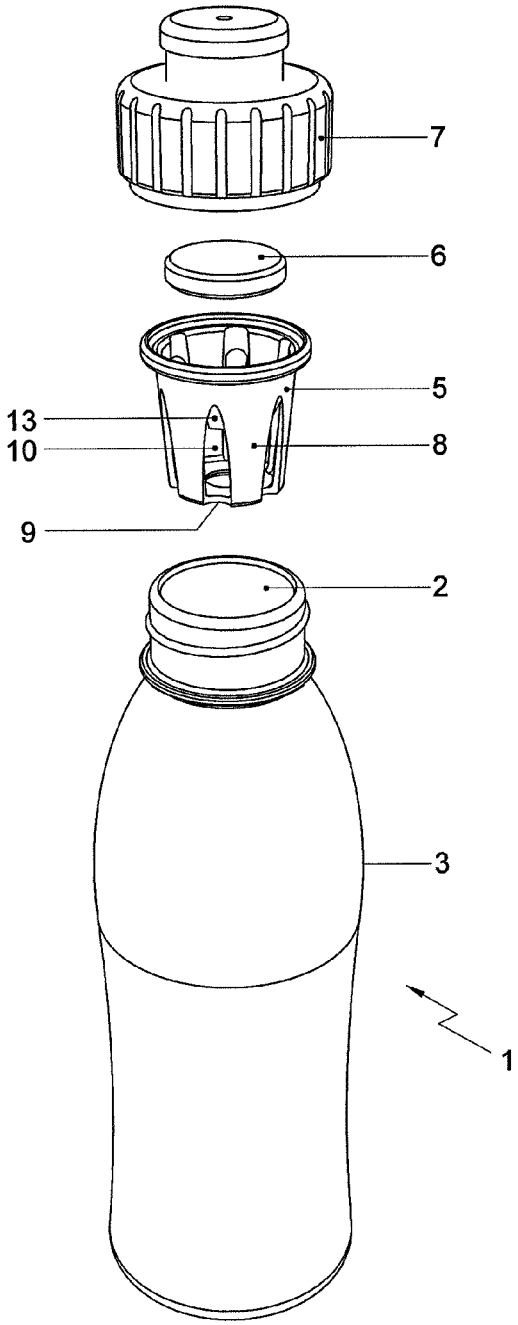
FIG. 5 shows a schematic perspective view of the drinking system of FIG. 1 in disassembled condition.
Figure 6:
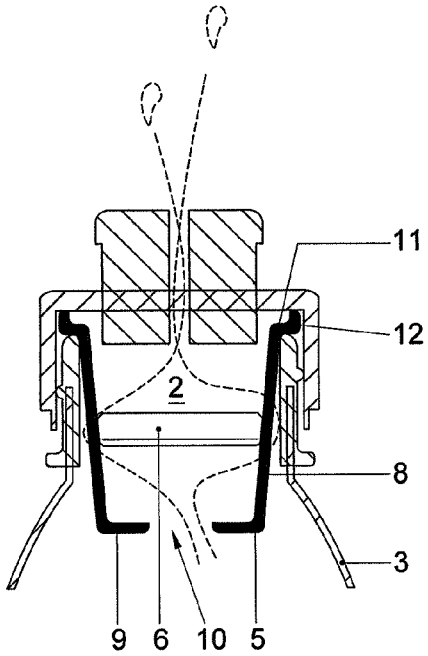
FIG. 6 shows a schematic cross-sectional detail view of the top side of the system of FIG. 4.
Figure 7:
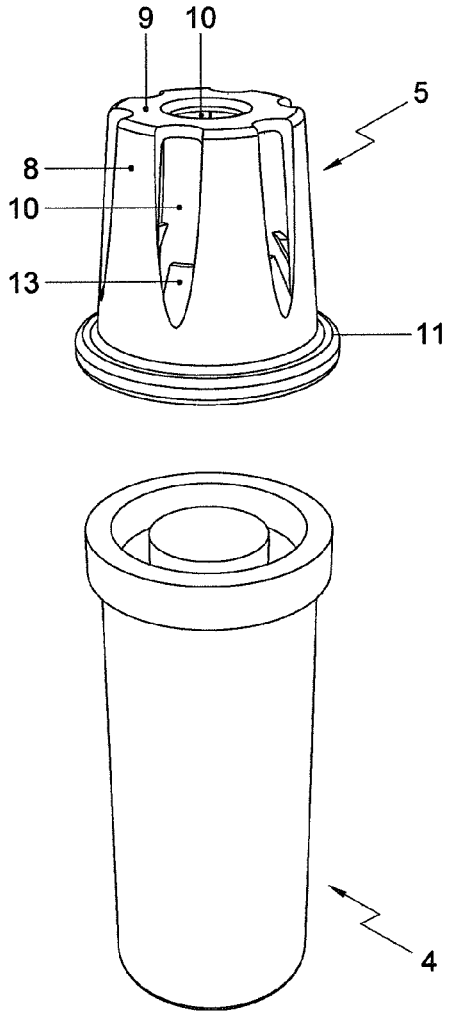
FIG. 7 shows a schematic perspective view of a replacement or alternative storage tube for holding a stock of additive and a dose container detachably coupled thereto.

FIGS. 4, 5 and 7 show a second configuration of the system in which the dose container 5 is received in the drinking bottle 3. In FIG. 6, it can clearly be seen that, when beverage is drunk from the drinking bottle 3 via the drinking cap 7, with the dose container 5, a dose 6 of additive is kept in the outflowing beverage, so that the additive is taken along by the outflowing beverage.

Here, the outflow opening 2 is formed by a cylindrical neck which has a relatively wide design to be able to receive the storage tube 4 or the dose container 5.

Here, the drinking bottle 3 is manufactured from plastic, but may of course also be manufactured from a different material, such as metal or glass.

Here, the drinking bottle 3 has a substantially transparent design, so that the user can clearly see the dose container 5 or the storage tube 4. Here, the drinking bottle 3 is designed without a label, so that looking in is not interfered with and an attractive appearance is obtained. The drinking bottle 3 may optionally be provided with an optionally transparent relief or printing. In an elegant manner, in circumferential direction of the drinking bottle, over at least a part of the height, over a part of the circumference, for instance half thereof, the wall of the bottle may have a less transparent design. In this manner, an attractive "look-in" packaging can be realized, in which the storage tube is presented against a contrasting background. The less transparent design may, for instance, be realized with the aid of a non-transparent label or a less transparent sleeve over virtually the whole height of the drinking bottle.

Here, the drinking cap 7 is designed as a push-pull cap often used in the prior art, but may of course also be designed as a different type of drinking cap, for instance a conventional screw cap with a drinking hole in the top side. Further, for instance, two different screw caps may be provided, for instance a normal closed screw cap and a screw cap with a drinking spout. With drinking cap 7, the dose container 5 or the storage tube 4 can be locked up in the drinking bottle.

The storage tube 4 is cylindrical and has a diameter which is smaller than the neck of the drinking bottle 3. In this exemplary embodiment, the storage tube is designed as a prismatic circular cylinder, but instead of prismatic, the tube may of course also, for instance, have a tapering design, and may further have a cross section different from a cylindrical shape. Here, the storage tube 4 has a liquid-tight design and is further airtightly closable. In this exemplary embodiment, the storage tube 4 is designed as a conventional plastic storage tube for effervescent tablets. The dose 6 of additive is then received as an effervescent tablet composed of a solid substance.

Such an effervescent tablet contains, for instance, bicarbonate, for instance sodium bicarbonate, which causes an effervescent effect, and a binding agent providing the tablet with a solid form. To the base of an effervescent tablet, then substances can be added which can make a positive contribution to one's health. Such substances may be incorporated in the formula of the effervescent tablet as a dry powder and may, for instance, comprise vitamins and minerals such as vitamin C, vitamin B and, for instance, calcium. In addition to vitamins and minerals, different substances are also possible, for instance substances of vegetable origin such as Panax Ginseng powder, Aloe Vera powder, Q10, caffeine, taurine and a variety of other substances with a favorable effect on one's health or performance. Aromatic substances and flavorings are also possible for an optimally attractive effervescent tablet in this invention. Here, possibilities are certain sugars such as glucose, fructose or dextrose and flavorings which are, for instance, derived from fruits or herbs.

Here, the dose container 5 is manufactured in one piece. As is clearly visible in FIG. 6, a tablet-shaped dose 6 may be clamped in the tablet container. Optionally, the tablet may also be provided with through-flow openings to facilitate the circumfluence of egressing liquid.

Here, the dose container 5 is designed as a conical basket whose circumferential edge and bottom are provided with openings 10. The dose container 5 is provided with a flange edge 11, with which it can be clamped on the edge 12 of the outflow opening 2 of the drinking bottle 3 via the drinking cap 7.

With the aid of the dose container 5, with a normal degree of filling, in standing orientation of the bottle, the dose 6 of additive incorporated in the tablet can be positioned above the liquid level h. It can thus be achieved that, during drinking, the tablet only temporarily contacts the liquid. Then the tablet does not disintegrate in advance in the liquid in the body of the drinking bottle. Only a small amount of the additive then ends up in the amount of beverage not yet consumed, so that the drinking bottle 3 is easy to clean after use.

The dose container 5 further positions the dose 6 of additive incorporated in the tablet upstream at a distance from the outflow opening 2. As a result, this prevents the tablet from obstructing the outflow, and it can further be achieved that, after passing of the tablet, still some mixing can take place.

The dose container 5 as shown here is manufactured in one piece, for instance in one injection molding operation from plastic material. As is shown in FIGS. 7 and 8, the dose container 5 may also be provided with spacers 13 to facilitate spacing between the tablet and the outflow opening 2.

Here, the drinking cap 7 is also designed from plastic material. Of course, it is possible to at least partly manufacture the drinking cap 7 from a different material, for instance metal or glass.

Figure 8:
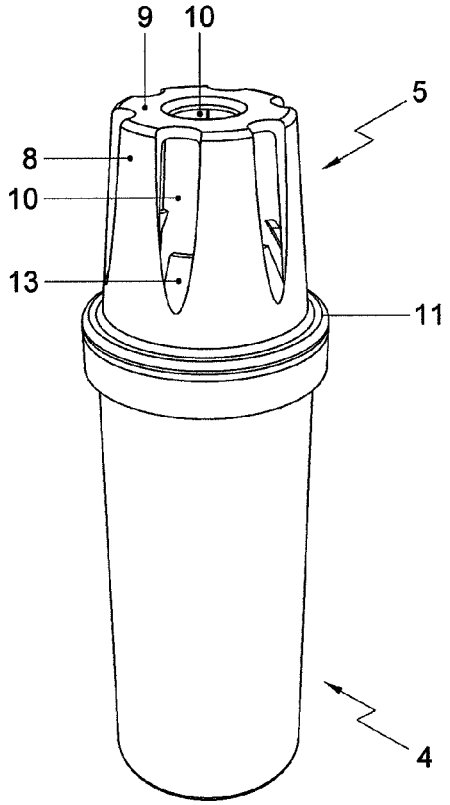
FIG. 8 shows a schematic perspective view of an assembly of FIG. 7 in disassembled condition.

It is noted that the combination of dose container 5 and storage tube 4 shown in FIGS. 7 and 8 may not only serve as a replacement of a used-up stock or to use a different additive. This configuration may also be used in combination with a standard bottle which is, for instance, already owned by the consumer.

Thus, the invention preferably provides a drinking system with the following components:

A transparent plastic bottle as a drinking bottle with a wide neck. On this neck, a push-pull cap can be placed. In the bottle, a standardized tablet tube may be placed as a storage tube. Then the bottle is preferably not filled with liquid. Precisely by packaging the tablet tube in the bottle, a special combination packaging is created. The bottle itself is preferably completely transparent, and is provided with a so-called sleeve or a label covering only about half of the bottle. On the one side of the bottle, then the label or a printing of the sleeve is visible, and on the other side of the bottle, the packaging of the tablets is visible. In this manner, it can be achieved that the bottle is an information carrier and provides an additional presentation of the product, while the unique composition with the tablet tube inside the bottle is still optimally visible. The tablet tube does have a label, and that is well readable through the bottle.

A tablet tube which fits in the bottle and in which tablets are packaged, preferably effervescent tablets. A tablet tube is, for instance, a standard packaging of 10 or 20 tablets. These tablets dissolve in water and each contain a dose of additive, preferably substances which are favorable to one's health, such as for instance vitamins and minerals.

A basket as a dose container which fits in the neck of the bottle and in which one or more effervescent tablets from the tablet tube can be placed. The basket with tablet is thus clamped between bottle and push-pull cap. The bottle is filled with water and, during drinking from the bottle, the water flows through the basket. This causes the effervescent tablet to dissolve in a dosed manner, and release the additive during drinking.

Advantages of such a drinking system are described hereinbelow.

The possibility to combine water with a health preparation in a simple and practical manner.

A special and striking manner of packaging. This packaging is not only attractive to see, but also saves much shelf space and promotes the reuse of the bottle.

The basket is easy to use and can easily be dosed when a standard filling of water is used. The basket further offers better dissolving possibilities in that the additive is washed along during drinking.

When an effervescent tablet is used, a slightly effervescent, fresh effect can be realized during drinking. Further, no colorings or preservatives are needed.

If desired, multiple tablets may be received in the basket, for instance multiple identical tablets to increase the dose, or for instance tablets with different types of additives.

It will be clear to a skilled person that the invention is not limited to the exemplary embodiment described herein. Many variants are possible within the scope of the invention as set forth in the following claims.

The invention claimed is:

1. A drinking system comprising:

a drinking bottle provided with an outflow opening;

a storage tube for holding a stock of additive; and a dose container holding a dose of the additive, wherein the storage tube and the dose container are, as alternatives, receivable in the drinking bottle via the outflow opening, and wherein the dose container holding the dose of the additive and the dose of the additive held in the dose container, when the dose container holding the dose of the additive is received in the drinking bottle, are in fluid communication with the drinking bottle and the outflow opening, such that a beverage disposed in the drinking bottle can pass through the dose container and mix with the additive held in the dose container when exiting the drinking bottle through the outflow opening.

2. The drinking system according to claim 1, wherein the outflow opening is formed by a cylindrical neck of the drinking bottle.

3. The drinking system according to claim 1, wherein the drinking bottle is from plastic.

4. The drinking system according to claim 1, wherein the drinking bottle is transparent.

5. The drinking system according to claim 1, wherein the drinking bottle is without a label.

6. The drinking system according to claim 1, wherein, in circumferential direction, over at least a part of the height, over a part of the circumference, the drinking bottle has a less transparent design.

7. The drinking system according to claim 1, wherein the outflow opening of the drinking bottle is provided with a drinking cap.

8. The drinking system according to claim 1, wherein the drinking bottle is provided with a cap or drinking cap which is detachably couplable with the dose container on a side facing away from the outflow opening.

9. The drinking system according to claim 1, wherein the storage tube is cylindrical.

10. The drinking system according to claim 1, wherein the storage tube is liquid-tightly and airtightly closable.

11. The drinking system according to claim 1, wherein the dose container is detachably couplable with the storage tube.

12. The drinking system according to claim 1, wherein the storage tube is provided with a printing on its outer surface.

13. The drinking system according to claim 1, wherein the storage tube is a tablet tube.

14. The drinking system according to claim 13, wherein the storage tube is filled with tablets.

15. The drinking system according to claim 14, wherein the tablets are effervescent tablets.

16. The drinking system according to claim 1, wherein the dose container is manufactured in one piece.

17. The drinking system according to claim 1, wherein the dose container is a basket provided with through-flow openings in bottom and side walls.

18. The drinking system according to claim 1, wherein the dose container is provided with a flange edge for being supported on the edge of the outflow opening of the drinking bottle.

19. The drinking system according to claim 1, wherein, with a normal degree of filling of the drinking bottle, in standing orientation of the drinking bottle, the dose container positions the dose above the liquid level of the beverage in the bottle.

20. The drinking system according to claim 1, wherein the dose container is provided with spacers for holding the dose at some distance from the outflow opening.

21. The drinking system of claim 1, wherein the dose of the additive in the dose container originates from the storage tube.

22. A drinking system, comprising a drinking bottle provided with an outflow opening and a dose container receivable in the drinking bottle via the outflow opening for holding a dose of additive, wherein the dose container holding the dose of the additive and the dose of the additive held in the dose container, when the dose container holding the dose of the additive is received in the drinking bottle, are in fluid communication with the drinking bottle and the outflow opening, such that a beverage disposed in the drinking bottle can pass through the dose container and mix with the additive held in the dose container when exiting the drinking bottle through the outflow opening.

23. A drinking system, comprising a tablet tube with a basket detachably coupled therewith for holding tablets, which basket is receivable in the outflow opening of a drinking bottle, which basket is provided with a flange edge for being supported on an edge of the outflow opening of the drinking bottle, and wherein the basket holding the tablets is provided with through-flow openings in a bottom and side walls, such that the basket and the tablets held in the basket, when received in the drinking bottle, are in fluid communication with the drinking bottle and the outflow opening, such that a beverage disposed in the drinking bottle can pass through the basket and mix with the tablet held in the basket when exiting the drinking bottle through the outflow opening.

* * * * *